US007238128B1

(12) United States Patent
Filice et al.

(10) Patent No.: US 7,238,128 B1
(45) Date of Patent: Jul. 3, 2007

(54) BALL CATCHING AND DELIVERY FRAME WITH VARIABLE FLEX SIDEWALLS

(75) Inventors: Gary Filice, Moorpark, CA (US); Dean E. Meyer, Oakbrook, IL (US)

(73) Assignee: Easton Sports, Inc., Van Nuys, CA (US)

( * ) Notice: Subject to any disclaimer, the term of this patent is extended or adjusted under 35 U.S.C. 154(b) by 119 days.

(21) Appl. No.: 10/928,330

(22) Filed: Aug. 27, 2004

(51) Int. Cl.
*A63B 59/02* (2006.01)
*A63B 65/12* (2006.01)

(52) U.S. Cl. ..... 473/513; D21/724

(58) Field of Classification Search ..... 473/512, 473/513, 505; D21/724
See application file for complete search history.

(56) References Cited

U.S. PATENT DOCUMENTS

| | | | | |
|---|---|---|---|---|
| 3,507,495 | A * | 4/1970 | Tucker et al. | 473/513 |
| RE31,419 | E | 10/1983 | Frolow | |
| 4,657,260 | A | 4/1987 | Brine | |
| 5,290,039 | A | 3/1994 | Cornelio | |
| 5,494,297 | A | 2/1996 | MacNeil | |
| 5,566,947 | A | 10/1996 | Tucker | |
| 5,568,925 | A | 10/1996 | Morrow | |
| 6,066,056 | A | 5/2000 | Morrow | |
| 6,447,410 | B2 | 9/2002 | Crawford | |
| 6,852,047 | B2 | 2/2005 | Tucker | |
| 2004/0058758 | A1 | 3/2004 | Kohler | |

* cited by examiner

*Primary Examiner*—Eugene Kim
*Assistant Examiner*—M. Chambers
(74) *Attorney, Agent, or Firm*—Olson & Hierl, Ltd.

(57) ABSTRACT

A frame for a ball catching and delivery head for use in, for example, the sport of lacrosse comprising a frame having a scoop, a base and spaced lateral sidewalls therebetween defining the periphery of a ball receiving and delivery face. Each of the lateral sidewalls includes a flex region which is more elastically compliant and resilient than the remainder of the frame. In one embodiment, the flex regions define regions of the sidewalls comprised of a material which is more flexible than the material comprising the remainder of the frame. In another embodiment, the flex regions are defined by springs incorporated into the sidewalls. In a further embodiment, the flex regions are defined by regions of the sidewalls of reduced height and cross-section. In a further embodiment, the sidewalls comprise separate, pivotable aft and fore frame/sidewall members.

32 Claims, 4 Drawing Sheets

210
295
291
292
290
297
296
240
295
293
226
294
280
220
270
284
282
298
280
250
226
256
222
216
254
228
299
224
239
32
212
297
256
228
299
286
234
214

346
302
360
300
306
362
320
304
308
350
354
358
370
356
356
346
312
352
340
364
368
382
386
380
331
332
364
368
352
314
300
354

BALL CATCHING AND DELIVERY FRAME WITH VARIABLE FLEX SIDEWALLS

FIELD OF THE INVENTION

The present invention relates to sports in which balls are caught and thrown using hand held or stick mounted scoops or frames such as may be used in jai lai and the sport of lacrosse and, more particularly, to a frame or head for a lacrosse stick in which the sidewalls thereof are adapted for flexing action.

BACKGROUND OF THE INVENTION

A ball catching and delivery frame, scoop or head of the type used in the sport of lacrosse and relating to the subject of the present invention is most typically made of injection-molded, monolithic, durable and rigid material such as, for example, nylon, urethane, or polycarbonate. Examples of lacrosse heads are disclosed in, for example, the following U.S. patents: U.S. Pat. No. 5,290,039 issued Mar. 1, 1994 to Cornelio; U.S. Pat. No. 5,568,925 issued Oct. 29, 1996 to Morrow, et al.; U.S. Pat. No. 5,566,947 issued Nov. 3, 1998 to Tucker, et al.; and U.S. Pat. No. 6,066,056 issued May 23, 2000 to Morrow.

The flexing capability of current heads and, more particularly, the lateral sides/sidewalls thereof, is determined by the configuration and/or resiliency and flexibility of the material from which the head and thus the sidewalls are constructed. However, because the heads are currently of a one-piece, monolithic, molded construction, the sidewalls are made from the same rigid material as the remainder of the head. Thus, the resiliency and flexing capability of the sidewalls is disadvantageously limited to the resiliency and flexing capability of the rigid head material.

It is thus an object of the present invention to provide a frame for a ball catching and throwing scoop, such as the frame of a lacrosse head, which includes lateral sides/sidewalls constructed in a manner wherein the resiliency and flexing characteristics and capabilities thereof is independent of the resilience and flexing characteristics and capabilities of the remainder of the head so as to allow a player to customize or adjust the flexing characteristics of the frame and sidewalls thereof to meet the player's specific style or needs.

SUMMARY OF THE INVENTION

The present invention relates to a ball catching delivery frame such as, for example, the head or frame of a lacrosse stick. The frame has a front/scoop wall, a rear/back stop wall and a pair of lateral sidewalls extending therebetween to define the periphery of a ball receiving and delivery face.

In accordance with the present invention, each of the lateral sidewalls includes means such as, for example, a flex region, which is more resilient than the remainder of the frame so as to allow for the flexure of the sidewalls.

In one embodiment, the sidewalls define respective upper and lower arms and the flex region is defined by a resilient member extending along the upper arm such as, for example, a spring adapted for elongation and contraction.

In additional embodiments, the flex region is defined by a region in each of the respective sidewalls of reduced height and cross-section. In one such embodiment, the sidewalls define a respective lower member defining respective aft sidewall recesses and respective flex members extend along the upper edge of the respective sidewalls above the respective recesses defined therein. Caps are adapted to cover the respective flex members. In another embodiment, the flex members define the arms of a generally wishbone shaped flex member which incorporates a base and cartridge adapted to be fitted within the interior of a cavity defined in the stick end receiving sleeve of the frame.

In yet another embodiment, the regions in the sidewalls of reduced height and cross-section define respective sidewall bridges and push rods are adapted to extend along the lower edge of the respective sidewalls below the respective bridges.

In still a further embodiment, the flex region is defined by respective pivotally connected fore and aft frame members. Stiffeners adapted to enhance the lateral stiffness of the frame are defined by respective fingers protruding out of an end face of the fore frame member and adapted to be fitted within the interior of respective pockets defined in the end face of the aft frame member.

Other advantages and features of the present invention will be more readily apparent from the following detailed description of the preferred embodiments of the invention, the accompanying drawings, and the appended claims.

DETAILED DESCRIPTION OF THE PREFERRED EMBODIMENTS

Figure 1:
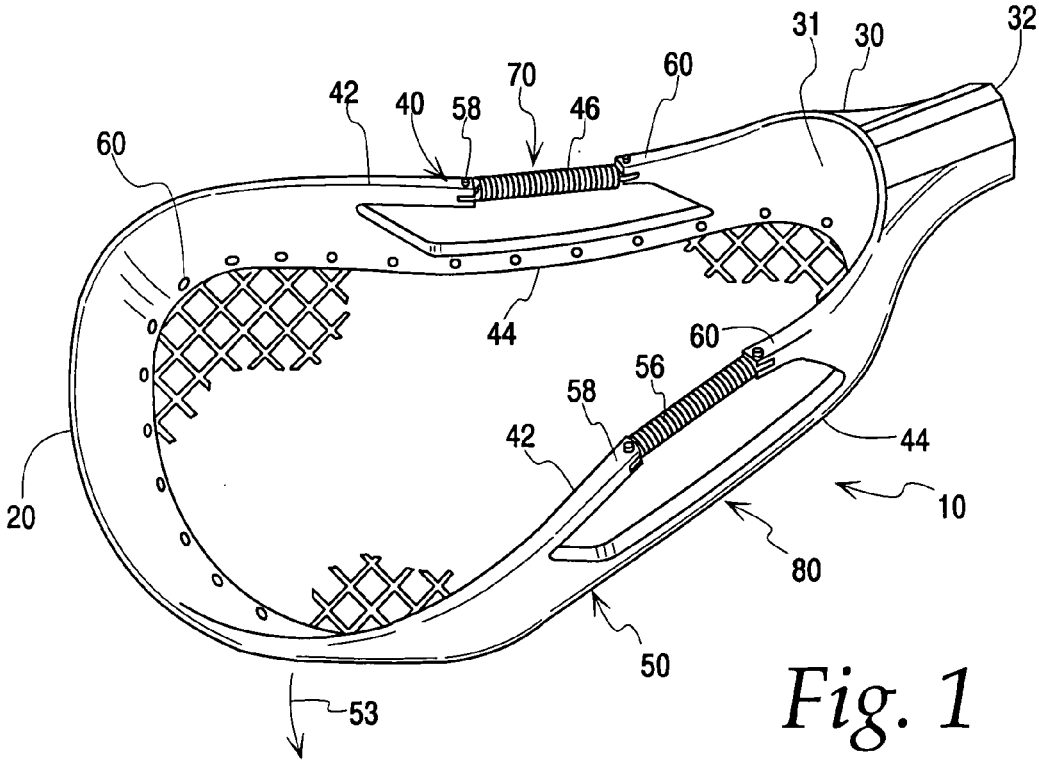
FIG. 1 is a perspective view of a first embodiment of the invention depicted in the form of a lacrosse head frame.

The invention disclosed herein is, of course, susceptible of embodiment in many different forms. Shown in the drawings and described herein below in detail are preferred embodiments of the frame of the present invention which is suitable, for example, to be used as the head for a lacrosse stick. It is to be understood, however, that the present disclosure is an exemplification of the principles of the invention and does not limit the invention to the illustrated embodiments.

For ease of description, the frame of the present invention is described herein below in reference to the general horizontal position thereof as shown in, for example, FIG. 1 and terms such as upper, lower, vertical, etc., will be used herein with reference to this position.

It is also understood that the FIGURES herein do not necessarily show or describe details of the frame that are known in the art and that will be recognized by those skilled in the art as such. The detailed descriptions of such elements are not necessary to an understanding of the invention.

Accordingly, such elements are herein represented, shown, and described herein only to the degree necessary to aid in an understanding of the features of the frame of the present invention.

Figure 2:
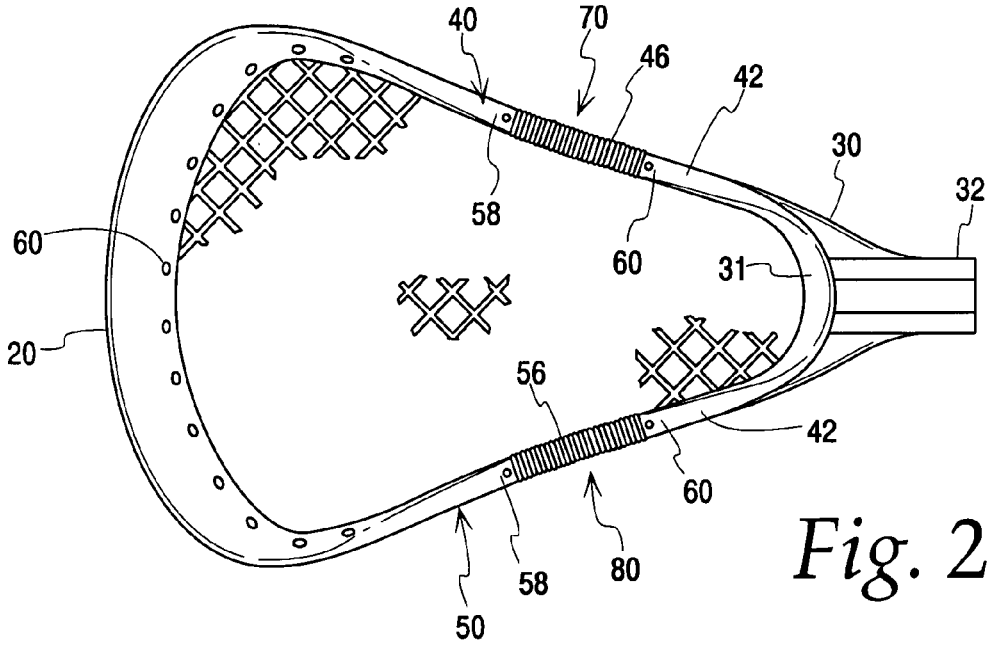
FIG. 2 is a top plan view of the frame of FIG. 1.
Figure 3:
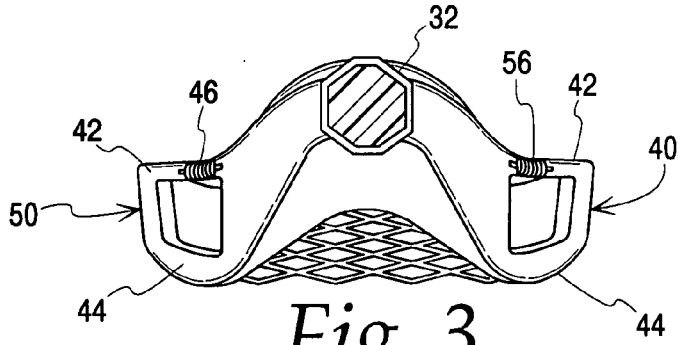
FIG. 3 is a rear elevational view of the stick receiving end and socket of the frame of FIG. 1.

FIGS. 1-3 depict a first embodiment of the invention in the form of a frame for a lacrosse head, the frame 10 having a front or scoop wall 20, a rear base 30 including a back stop wall 31 and a hollow sleeve or socket 32 adapted to receive the end of a handle or stick (not shown), and lateral sides or walls 40 and 50 extending unitarily between the base 30 and scoop wall 20. The back stop wall 31, sidewalls 40 and 50, and scoop wall 20 together define the periphery of a ball receiving and delivery face, the upper side of which is shown in FIGS. 1 and 2. Presently preferred materials from which the frame may be manufactured include fiber reinforced thermoplastic or thermoset plastics. Suitable examples include, but are not limited to, graphite, nylon and those materials sold under the trademark Santoprene™.

The frame 10 may include conventional known means such as holes or eyelets 60 for attaching a net or webbing (shown in broken fashion in FIGS. 1-3) to the frame 10. Alternatively, and although not shown, it is understood that the net or webbing could be replaced with a rigid bottom so that the frame may be useful in sports other than lacrosse.

In accordance with the present invention, the lateral sidewalls 40 and 50 of the frame 10 define respective resilient and flexible aft regions or sections 70 and 80 which are more resilient and flexible than the remainder of the frame 10 and sidewalls 40 and 50. In the embodiment of FIGS. 1-3, the resilient and flexible sidewall regions or sections 70 and 80 are defined by portions of the sidewalls 40 and 50 which incorporate respective tension springs 46 and 56. Although FIGS. 1-3 depict a frame 10 where the springs 46 and 56 comprise separate elements which are adapted to be separately secured and connected to the sidewalls of the frame 10, it is understood that the present invention likewise encompasses the use of spring-like elements formed integrally or unitarily with the sidewalls 40 and 50 of the frame 10 during the fabrication and molding process such as, for example, where a portion of the sidewalls is made of a more flexible and resilient material than the rest of the frame 10 and sidewalls 40 and 50.

In the embodiment of FIGS. 1-3, the frame sidewalls 40 and 50 each include and define spaced upper and lower generally longitudinally extending edges or arms 42 and 44 respectively in which the resilient and flexible sidewall regions 70 and 80 comprise respective stretchable and flexible regions or lengths of the upper sidewall arms 42. As described above, the respective flex regions 70 and 80 may comprise any suitable resilient and flexible sidewall structure of desired compliance such as, for example, the tension springs 46 and 56 shown in FIGS. 1-3, elastomeric tendons, or any other suitable structural equivalent capable of elongation, contraction, and flexure so as to allow for the flexing and pivoting of the fore sections of the sidewalls 40 and 50 and the scoop 20 relative to the aft section of the sidewalls 40 and 50 in an up and down direction generally transverse or opposite the longitudinal axis of frame 10 (see the arrow 53 in FIG. 1). Different springs may be substituted to allow the flexure characteristics of frame 10 to be varied and adjusted to meet a player's particular needs.

In the embodiment of FIGS. 1-3, the opposed ends of the springs or tendons 46 and 56 are affixed in any suitable fashion to the free ends of the fingers 58 and 60 of the respective upper sidewall arms 42 such as, for example, by pins, hooks or eyes associated with either the ends of the springs 46 and 56 or the ends of the fingers 58 and 60. Although not shown, it is understood that the springs or tendons 46 and 56 can also be provided with enlarged ends adapted to be received in hollow pockets or sockets of complementary size formed in the interior end faces of the fingers 58 and 60 of the respective upper sidewall arms 42 of each of the sidewalls 40 and 50.

Figure 4:
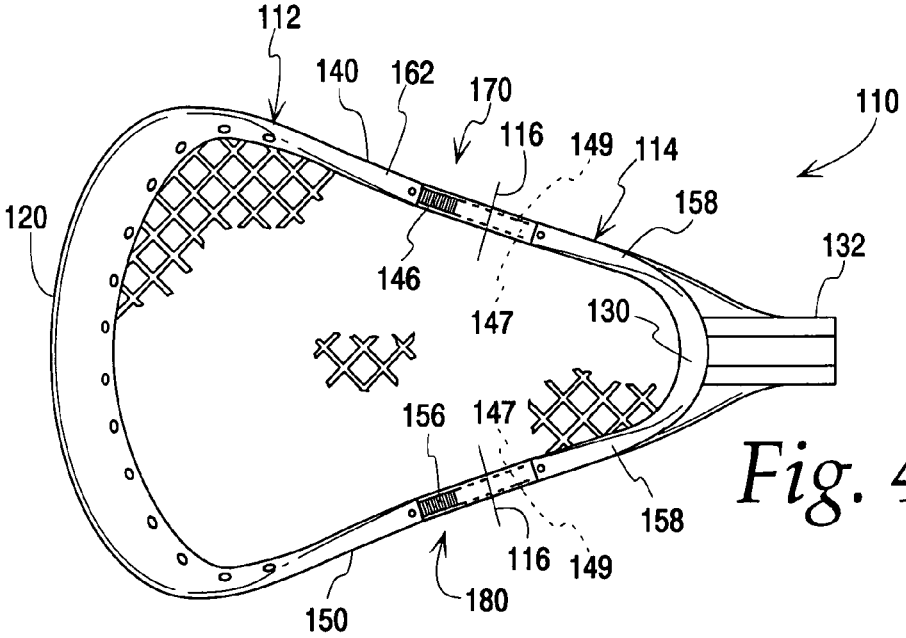
FIG. 4 is a top plan view of a second embodiment of a lacrosse head frame of the present invention.
Figure 5A:
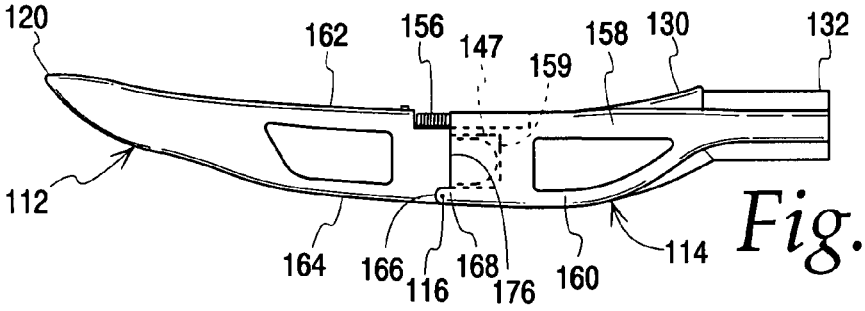
FIGS. 5*a* and 5*b* comprise side elevational views of the second embodiment of FIG. 4 in the at rest and flexed positions of the frame respectively.
Figure 5B:
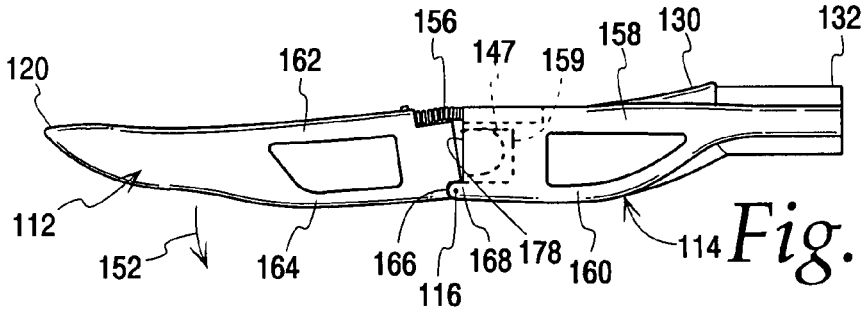

FIGS. 4, 5*a* and 5*b* depict a second embodiment, also depicted in the form of a lacrosse head frame 110, in which the frame 110 includes flexible sidewall regions 170 and 180 defined by pivotally connected independent fore and aft frame/sidewall members 112 and 114 respectively which permit movement and flexing of the scoop 120 and fore frame member 112 with respect to, independent of, and relative to the aft frame member 114 and base 130 about pivot axes 116 in an up and down direction generally transverse to the frame longitudinal axis (see the arrow 152 in FIG. 5*b*). The fore frame member 112 incorporates the scoop 120 and the aft frame member 114 incorporates the base 130 and sleeve 132. In this embodiment, the aft frame member 114 and, more particularly, the portion of the sidewalls 140 and 150 defining the aft frame member 114 define respective upper and lower sidewall arms/edges 158 and 160 respectively while the fore frame member 112 and the portion of the sidewalls 140 and 150 defining the fore frame member 112 define respective upper and lower frame/sidewall arm/edges 162 and 164 respectively.

In accordance with this embodiment, the proximal end 166 of each of the respective lower frame edges/arms 162 of fore frame member 112 are connected to and pivot about the distal end 168 of each of the respective lower sidewall arms/edges 160 of each of the sidewalls 140 and 150 defining aft frame member 114. Moreover, springs 146 and 156 extend between the proximal end 172 of the upper frame edges/arms 162 respectively of the fore frame member 112 and the distal end 174 of the upper arms/edges 158 respectively of the aft frame member 114. Different springs may be substituted to allow a player to customize the flexing characteristics of the frame 110.

In this embodiment, the frame 110 is provided with lateral stiffeners defined in combination by respective tongues 147 protruding unitarily outwardly from the proximal end face 176 of each of the respective opposed sidewall sections of sidewalls 140 and 150 defining fore frame member 112 and respective pockets or sockets 149 defined in and extending into the distal end face 178 of the respective opposed sidewall sections of sidewalls 140 and 150 which define aft frame member 114. In accordance with this embodiment, the respective tongues 147 are telescopingly fitted within the interior of the respective sockets 149 for enhancing and protecting the lateral stiffness of the frame 110 as the fore frame member 112 is flexed relative to the aft frame member 114.

Figure 6:
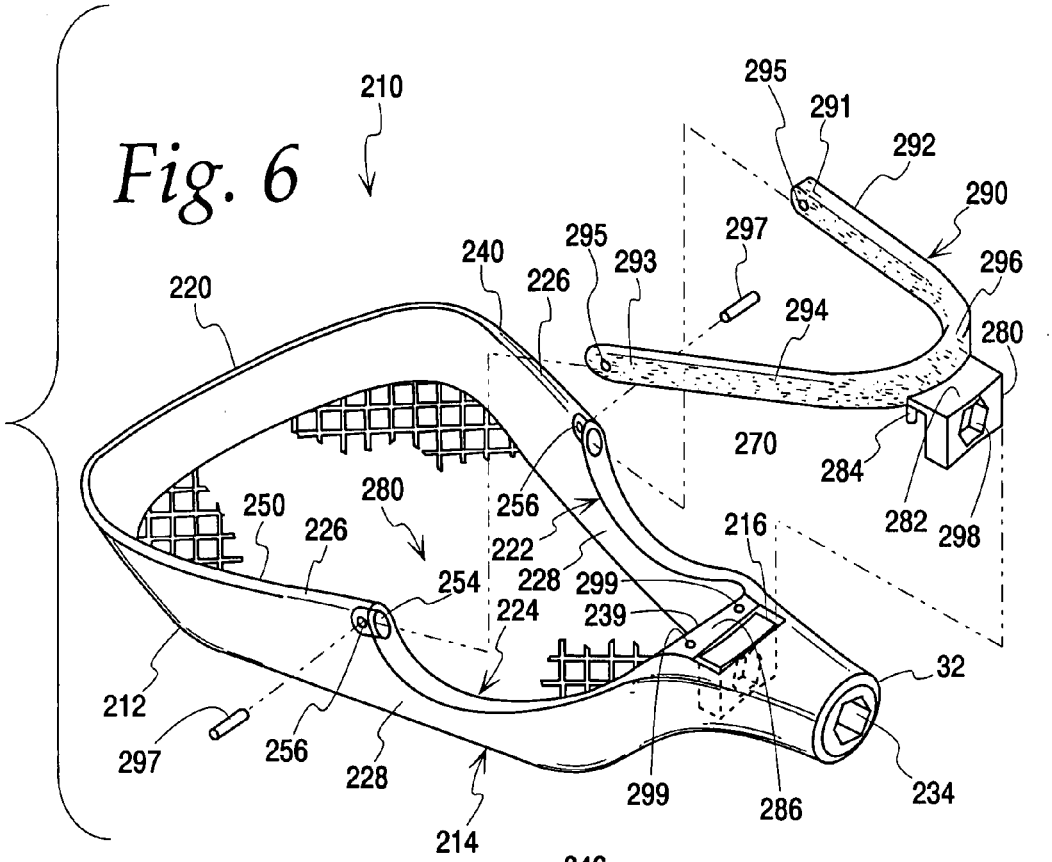
FIG. 6 is an exploded perspective view of a further embodiment of a lacrosse head frame in accordance with the present invention.

FIG. 6 depicts an exploded perspective view of another lacrosse head frame embodiment 210 in which the lateral sidewalls 240 and 250 thereof include respective fore and aft frame/sidewall sections 212 and 214 wherein the height/cross-section of the sidewalls 240 and 250 in the region of the aft section 214 is about half or less than half of the height/cross-section of the respective sidewalls 240 and 250 in the fore section 212 so as to define respective arcuate elongate recesses, depressions or indentations 222 and 224 extending downwardly from the upper edge 226 of each of the sidewalls 240 and 250 and into the body 228 thereof in the region of the aft sidewall section 214. The distal ends of the respective portions of the sidewalls 240 and 250 defining the fore frame/sidewall section 212 extend into the scoop wall 220 while the proximal ends of the respective portions of the sidewalls 240 and 250 defining the aft sidewall section 214 extend into the base 230 of frame 210. The recesses/depressions 222 and 224 thus define a frame 210 with respective flex regions 270 and 280 of increased compliance relative to the remainder of the sidewalls 240 and 250.

Frame embodiment 210 additionally comprises a generally wishbone shaped flex or spring member 290 including spaced-apart arms 292 and 294. The arms 292 and 294 are adapted to extend generally longitudinally over the respective recesses 222 and 224 in aft sidewall section 214 and include free distal fingers 291 and 293 respectively adapted to cooperate and be fitted into respective cavities 253 and 254 defined in and protruding into an upper longitudinal edge 226 of each of the sidewalls 240 and 250 in the region of the fore end of the respective recesses/depressions 222 and 224.

The arms 292 and 294 are secured to the frame 210 by pins 297 or the like. More particularly, each of the sidewalls 240 and 250 defines a through aperture 256 extending between the opposed faces of the sidewalls 240 and 250 in the region of the cavities 252 and 254 defined therein and each of the fingers 291 and 293 of wishbone flex member 290 defines a respective trough bore 295 extending therethrough and adapted for alignment with the respective through aperture 256 defined in sidewalls 240 and 250 when the fingers 291 and 293 are inserted into the sidewall cavities 252 and 254 respectively. The pins 297 are slid successively through the respective apertures 256 and respective bores 295 for locking the arms 292 and 294 to the frame 210 in a relationship wherein the arms 292 and 294 overly the respective recesses/depressions 222 and 224 and are generally vertically co-planarly aligned with respective sidewalls 240 and 250.

The arms 292 and 294 of wishbone flex member 290 terminate in a generally U-shaped base 296. Wishbone flex member 290 additionally comprises a generally square shaped bracket or cartridge 280 which extends rearwardly from the base 296 thereof and defines a stick receiving through aperture 298 preferably of the same size and cross section as the hollow interior bore defined in the sleeve 232.

The base 230 of frame 210 comprises a stick attachment end having a stick or handle receiving sleeve 232 defining an interior bore 234 of non-circular, usually hexagonal cross-section for receiving a hexagonally shaped stick or handle (not shown). Sleeve 232 additionally defines a generally square shaped recess or cavity 216 defined in the top surface thereof and extending through the body thereof in a direction generally normal to the longitudinal axis of sleeve 232 and the through aperture 234 defined therein. According to this frame embodiment, when wishbone member 290 is secured to the top of frame 210, cartridge 280 is loaded and fitted within the interior of cavity 216 in a relationship wherein the aperture 298 defined therein is in co-linear alignment with the through aperture 234 defined in sleeve 232. Cartridge 280 additionally defines a top platform 282 having a pair of spaced-apart pins 284 extending outwardly from the bottom surface thereof and adapted to be slid into respective apertures 299 defined in the top surface 286 of base 230 of frame 210 to assist in the positioning, placement and securement of the wishbone member 290 over the frame 210 and the sidewalls 240 and 250 in the relationship where the bottom surface of platform 282 is abutted against the top surface 286 of base 230 and cartridge 280 is located within the interior of base cavity 216.

In accordance with the invention, the wishbone member 290 can be made entirely of a resilient elastomer and preferably has a color which contrasts with the color of the remainder of the frame 210. Different wishbone members 290 can be provided in different colors for identifying and selecting wishbone members having different resiliency characteristics such as, for example, soft, medium and firm which, of course, as a result of the connection between arms 292 and 294 and the frame 210, determines and affects the flexibility characteristics of fore frame/sidewall section 212 relative to the aft frame/sidewall section 214 in a direction generally transverse to the longitudinal frame axis.

Figure 7:
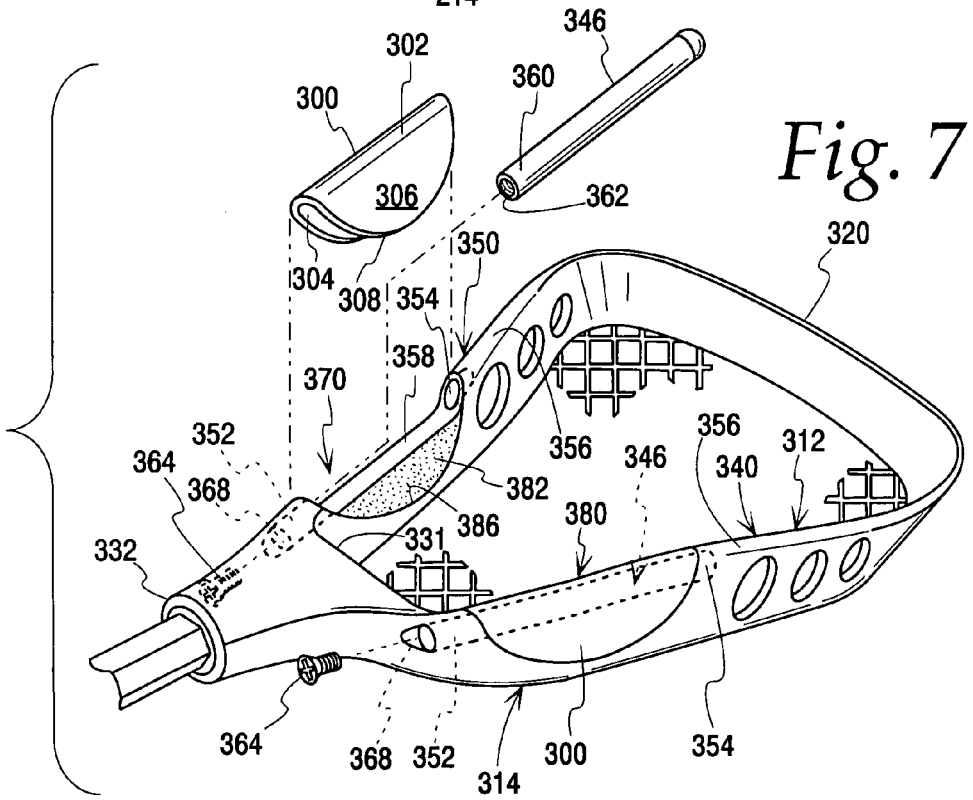
FIG. 7 is an exploded perspective view of still a further embodiment of a lacrosse head frame according to the present invention.

FIG. 7 depicts another frame embodiment 310 including a distal scoop wall 320, a back stop wall 331, a base 330 extending into a sleeve 332, and lateral sidewalls 340 and 350 extending unitarily therebetween in a manner similar to the frame embodiment depicted in FIG. 6. Frame 310 and sidewalls 340 and 350 are divided into and define fore and aft frame or sidewall sections 312 and 314 similar in structure to the fore and aft frame/sidewall sections 212 and 214 of the frame 210 and thus defining an aft frame/sidewall section 214 where the respective sidewall portions thereof define respective recessed or depressed frame/sidewall regions 370 and 380 of a reduced height/cross-section and increased flexibility and compliance relative to the height/cross-section of the portion of the sidewalls 340 and 350 defining fore frame/sidewall section 312.

Frame 310 includes a pair of separate, elongate tendons 346, preferably made of rubber or the like stretchable and compressible elastomeric material and adapted to be secured and located on the respective sidewalls 340 and 350 and, more particularly, adapted to overly the recessed aft frame/sidewall regions 370 and 380 respectively. Frame 310 also defines respective interior cavities 352 and 354 which are defined along an upper longitudinal edge 356 of each of the sidewalls 340 and 350 and are positioned at opposite ends of the respective recessed regions 370 and 380. The tendons 346 are secured to the frame 310 in a relationship wherein the respective ends thereof are fitted and snapped into the respective sidewall cavities 352 and 354 in each of the sidewalls 340 and 350 and the elongate tendons 346 are seated against the top outer face 358 of each of the recessed aft frame/sidewall regions 370 and 380.

It is appreciated that if coil tension springs or tendons 346 are used, one of the ends 360 of each of the tendons 346 may define a threaded hollow interior 362 adapted to receive respective tension adjustment screws 364 and 366 which are fitted through respective openings 368 and 372 and the respective cavities 352 defined in the base 330 of the frame 310 for locking the tendons 346 in place and also for allowing the adjustment of the tension in the tendons 346 (and thus the flexure of sidewalls 340 and 350 in a direction generally transverse or normal to the frame longitudinal axis) by either tightening or loosening the screws as desired.

Covers or caps 300, each preferably made of plastic or the like elastomeric material which has been molded generally in the form and shape of an inverted taco shell or the like, are adapted to be snapped over the upper edge 356 and opposed side faces of the respective sidewalls 340 and 350 in the region of the recessed aft frame/sidewall sections regions 370 and 380 thereof for concealing and protecting the tendons 346 from damage during play. More particularly, and as shown in FIG. 7, each of the caps 300 includes a top arcuate wall 302 and two spaced-apart sidewalls 304 and 306 defining respective arcuate lower peripheral edges 308. Each of the recessed frame/sidewall regions 370 and 380 define respective inner and outer faces 382 and respective arcuate shoulders 386. Caps 300 are seated and snapped over the top of the respective recessed aft frame/sidewall regions 370 and 380 in a relationship wherein the top wall 302 thereof overlies the tendons 346, the sidewalls 304 and 306 thereof are positioned in abutting relationship against the respective inner and outer faces 382 of recessed frame/sidewall regions 370 and 380 respectively, and the respective lower arcuate edges 308 of the respective caps 300 are adapted to be seated against the respective arcuate shoulders 386 also defined by respective recessed frame/sidewall regions 370 and 380.

Figure 8:
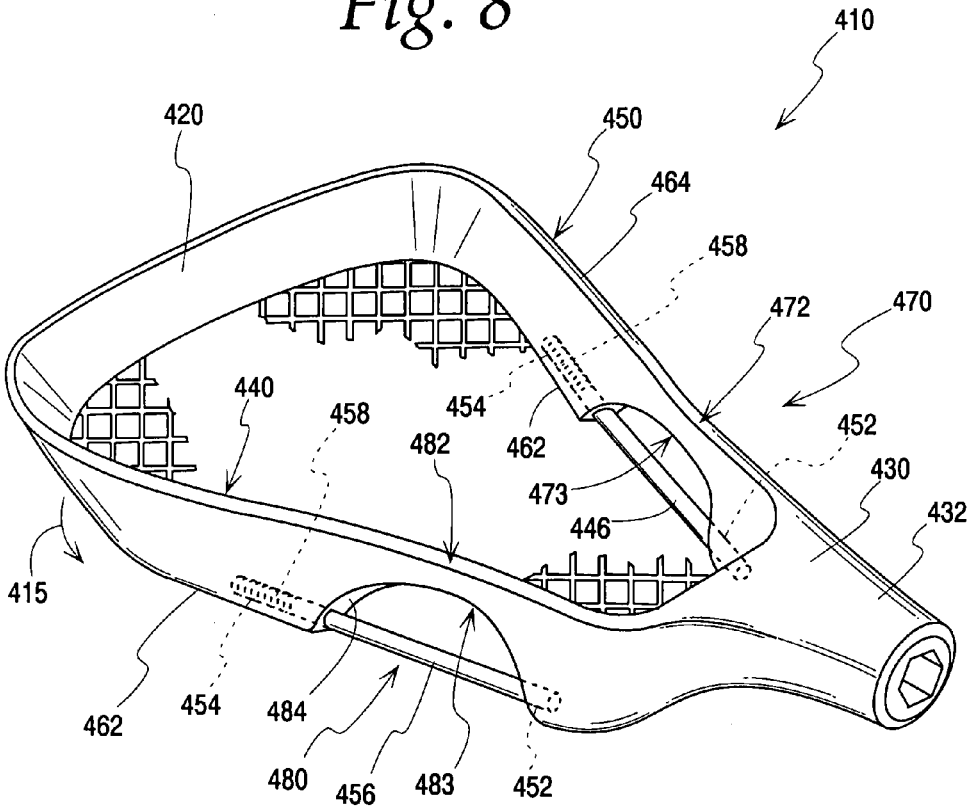
FIG. 8 is a perspective view of yet a further embodiment of a lacrosse head frame according to the present invention.

The frame embodiment 410 of FIG. 8, which includes a fore scoop wall 420, sidewalls 440 and 450, base 430 and sleeve 432, obtains increased flex or compliance by providing aft frame/sidewall regions 470 and 480 in the sidewalls 440 and 450 defining respective elongate aft sidewall bridges 472 and 482. The bridges 472 and 482 are defined by portions of the sidewalls 440 and 450 from which material has been removed along the lower peripheral edge 462 thereof so as to define respective arcuate sidewall cut-outs 473 and 483 extending upwardly from the lower edge 462 in the direction of the upper longitudinal edge 464 of the sidewalls 440 and 450 respectively. The bridges 472 and 482 thus define flex regions 470 and 480 about which fore frame/sidewall section 412 flexes or bends relative to aft frame/sidewall section 414 in a direction generally transverse and below the frame longitudinal axis as viewed from the perspective of FIG. 8 and the arrow 415 therein.

Frame 410 additionally includes a pair of elongate push rods 446 and 456 adapted to extend across the opening or space defined below each of the aft frame/sidewall bridges 472 and 482 by the cut-outs 473 and 483 in the sidewalls 440 and 450 respectively. As shown in FIG. 8, the opposed ends of the respective push rods 446 and 456 extend through respective cavities 452 and 454 defined in and extending along and through the lower longitudinal edge 462 of each of the sidewalls 440 and 450 and located at the opposite ends of the underside face 484 of the respective frame/sidewall bridges 472 and 482. A compression spring 458 is seated within the interior of each of the sidewall cavities 452 and 454 and the fore end of each of the push rods 446 and 456 is extended into the respective cavities 452 and 454 into abutting relationship with and against the respective compression springs 458. In accordance with the present invention, the flexure of the fore frame/sidewall section relative to aft frame/sidewall section, i.e. flexure about bridges 472 and 482 causes the compression of springs 458 which are sandwiched between the end of respective cavities 454 and the respective ends of rods 456 in abutting relationship with springs 458.

Although the compression springs 458 are preferably located in the fore sidewall apertures 454, it is understood that similar springs may likewise be seated within the interior of the respective aft sidewall apertures 452 or, alternatively, that similar springs may be seated within the interior of all four of the sidewall cavities 452 and 454 for increased frame flexing action. It is also understood that different springs with different spring compression and elongation characteristics may be substituted so as to allow for the customization by a player of the flexing and bending characteristics of fore frame/sidewall section 412 relative to the aft frame/sidewall section 414 about the respective flex regions 470 and 480 thereof.

Although all of the embodiments described above and shown in the FIGURES relate to the use of spring or the like members for providing resilience and flexibility to the sidewalls of the frame, those skilled in the art will understand that the invention likewise encompasses frame embodiments wherein the frame is made from one rigid material and the sidewall regions or sections of reduces height are made from a second material more compliant, resilient and flexible than the material comprising the remainder of the frame.

The increased elastic compliance of the frames of the present invention is thus capable of increasing the flexibility and resilience of the respective frames while retaining the desired lateral stiffness of the respective frames as compared with prior art frames since prior art frames essentially function as truss structures without any specially designed increase in compliance in selected regions to assist in flexing and resiliency. If separate tension or compression springs are utilized, they may be prestressed as desired when installed in the frame.

It will be readily apparent from the foregoing description of the invention and from the illustrations thereof that numerous variations and modifications may be effected without departing from the true spirit and scope of the novel concepts or principles of the invention.

We claim:

1. A ball catching and delivery frame having a monolithic portion with a front, a rear and lateral sides therebetween together defining the periphery of a ball receiving and delivery face wherein each of the lateral sides includes a flex region disposed between adjacent side regions of preselected cross-sectional size, the flex region having a reduced cross-sectional size which renders the flex region more flexible than the adjacent side regions, and a resilient member spanning the flex region so as to resist flexing of the flex region.

2. The frame of claim 1, wherein each resilient member comprises a compression spring.

3. The frame of claim 1, wherein each resilient member comprises a coil spring.

4. The frame of claim 1, wherein said flex regions of said lateral sides define respective arcuate recesses formed in aft sections of said lateral sides, respectively.

5. The frame of claim 1, further comprising a cap adapted to cover each of said resilient members.

6. The frame of claim 1, wherein said flex regions define respective bridges in said respective lateral sides.

7. A head for a lacrosse stick comprising a scoop wall, a back stop wall and a pair of sidewalls extending therebetween, each of the sidewalls incorporating a flex portion adapted to allow for the flexure of said sidewalls, comprising at least one arm of reduced height and cross-section relative to adjacent portions of the sidewalls, biased with a resilient member carried by the arm that resists flexing of said flex portion.

8. The head of claim 7, wherein each of said sidewalls define at least one arm and said resilient member comprises a spring carried by said arm so as to span at least a part of said flex portion.

9. The head of claim 7, wherein said flex portions of said sidewalls define respective arcuate recesses formed in aft sections of said sidewalls, respectively.

10. The head of claim 7, wherein a cap is adapted to cover each of said resilient members.

11. The head of claim 7, wherein said flex portions define respective bridges in said respective sidewalls.

12. The head of claim 7, wherein the head defines a longitudinal axis and the sidewalls are provided with a stiffness that limits the flex portions to flexing in a direction generally transverse to the longitudinal axis.

13. The head of claim 7, wherein the scoop wall, back stop wall and pair of sidewalls define a plane and the direction of flexing of the sidewalls is generally perpendicular to the plane.

14. A ball catching and delivery frame having a monolithic portion with a front, a rear and lateral sides therebetween together defining the periphery of a ball receiving and delivery face wherein each of the lateral sides includes a predetermined cross-sectional size extending between opposed top and bottom edges, with each of the lateral sides defining a recess extending upwardly from the bottom edge and below an overlying flex region of reduced cross-sectional size that is more resilient than the remainder of the frame, and a resilient member spanning the recess so as to resist flexing of the flex region.

15. The frame of claim 14, wherein each resilient member comprises a compression spring.

16. The frame of claim 14, wherein each resilient member comprises a coil spring.

17. The frame of claim 14, further comprising a cap adapted to cover each of said resilient members.

18. The frame of claim 14, wherein said flex regions define respective bridges in said respective lateral sides.

19. The frame of claim 14, wherein the monolithic portion defines a longitudinal axis and the lateral sides are provided with a stiffness that limits the flex regions to flexing in a direction generally transverse to the longitudinal axis.

20. The frame of claim 14, wherein the monolithic portion defines a plane and the direction of flexing is generally perpendicular to the plane.

21. A head for a lacrosse stick comprising a scoop wall, a back stop wall and a pair of sidewalls extending therebetween, each of the sidewalls having a predetermined cross-sectional size extending between opposed top and bottom edges, with each of the sidewalls defining a recess extending upwardly from the bottom edge to define a flex portion spanning the recess, of reduced height and cross-section relative to adjacent portions of the sidewalls, and a resilient member carried by the sidewalls that resists flexing of said flex portions.

22. The head of claim 21, wherein each of said sidewalls define at least one arm and said resilient member comprises a spring carried by said arm so as to span at least a part of said flex portion.

23. The head of claim 21, wherein said flex portions of said sidewalls define respective arcuate recesses formed in aft sections of said sidewalls, respectively.

24. The head of claim 21, further comprising a cap adapted to cover each of said resilient members.

25. The head of claim 21, wherein said flex portions define respective bridges in said respective sidewalls.

26. The head of claim 21, wherein the head defines a longitudinal axis and the sidewalls are provided with a stiffness that limits the flex portions to flexing in a direction generally transverse to the longitudinal axis.

27. The head of claim 21, wherein the head defines a plane and the direction of flexing of the sidewalls is generally perpendicular to the plane.

28. A ball catching and delivery frame defining a longitudinal axis, and having a monolithic portion with a front, a rear and lateral sides therebetween, together defining the periphery of a ball receiving and delivery face wherein each of the lateral sides includes a flex region disposed between adjacent side regions of preselected cross-sectional size, the flex region having a reduced cross-sectional size which renders the flex regions more flexible than the adjacent side regions, a resilient member spanning each flex region so as to resist flexing of the flex region, and the lateral sides being provided with a stiffness that limits the flex regions to flexing in a direction generally transverse to the longitudinal axis.

29. The frame of claim 28, wherein said flex regions of said lateral sides define respective arcuate recesses formed in aft sections of said lateral sides, respectively.

30. The frame of claim 28, further comprising a cap adapted to cover each of said resilient members.

31. The frame of claim 28, wherein said flex regions define respective bridges in said respective lateral sides.

32. The frame of claim 28, wherein the ball receiving and delivery face defines a plane and the direction of flexing is generally perpendicular to the plane.

* * * * *